US006822201B2

(12) United States Patent
Park

(10) Patent No.: US 6,822,201 B2
(45) Date of Patent: Nov. 23, 2004

(54) LAUNDRY DRYER

(75) Inventor: Sang Ho Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/717,991

(22) Filed: Nov. 21, 2003

(65) Prior Publication Data

US 2004/0169034 A1 Sep. 2, 2004

(30) Foreign Application Priority Data

Nov. 26, 2002 (KR) ..... P 10-2002-0073876

(51) Int. Cl.[7] ..... H05B 1/02

(52) U.S. Cl. ..... 219/489; 219/419; 219/508; 219/494; 361/166

(58) Field of Search ..... 219/489, 494, 219/497, 508, 519; 361/166, 167, 191; 307/43

(56) References Cited

U.S. PATENT DOCUMENTS 4,144,552 A * 3/1979 Sibalis ..... 361/166
4,230,935 A * 10/1980 Meixner ..... 219/523
4,390,790 A * 6/1983 Rodriguez ..... 250/551
4,477,982 A * 10/1984 Cotton ..... 34/550
5,354,972 A * 10/1994 Han ..... 219/715

* cited by examiner

*Primary Examiner*—Mark Paschall
(74) *Attorney, Agent, or Firm*—McKenna Long & Aldridge LLP

(57) ABSTRACT

A laundry drier has a heater control circuit for controlling the drive of a heater using one of a plurality of high voltages, using a switching circuit realized by a form C contact relay provided between a current-buffered microcomputer output and plurality of heater drivers, so that heater drive capability is ensured even if the current buffer output fails and so that dangerous short-circuit conditions are avoided even if the microcomputer experiences a logical malfunction. The heater control circuit includes a heater for being driven by a plurality of high voltages via a plurality of heater drivers; a microcomputer for outputting a control signal according to a user input, the control signal determining the high voltage drive of the heater; and a heater control interface for generating a plurality of heater control signals corresponding to the plurality of high voltages, based on the control signal of the microcomputer, the plurality of heater control signals selectively enabling only one heater driver.

9 Claims, 2 Drawing Sheets

LAUNDRY DRYER

This application claims the benefit of Korean Application No. 10-2002-0073876 filed on Nov. 26, 2002, which is hereby incorporated by reference.

BACKGROUND OF THE INVENTION

1. Field of the Invention

The present invention relates to laundry dryers, and more particularly, to an apparatus for controlling a heater in a laundry dryer provided with a heater control interface for the control of a plurality of high voltages for driving the heater.

2. Discussion of the Related Art

In general, a laundry dryer is an apparatus for drying wet objects, e.g., clothes, after completion of a washing cycle or the like. FIG. 1 illustrates the circuit of a heater controller in a laundry dryer according to a related art.

Referring to FIG. 1, the heater control circuit is comprised of a microcomputer 10 for outputting a control signal according to a user input, a current buffer 20 for outputting a plurality of heater control signals based on the control signal of the microcomputer, and a heater drive unit 40 having a plurality of heater drivers for driving a heater 30 using one of a plurality of high voltages as determined by the heater control signals. Here, the plurality of high voltages is provided so that the heater 30 may be efficiently driven using a current appropriate for a given type of laundry according to a user selection. Typically, two such voltages are available for use in an ordinary household, and as a rule, these voltages are 110 volts and 220 volts. In other settings, such as an industrial or commercial environment, higher voltages may be additionally available.

The control signal of the microcomputer 10 is output via first and second ports S1 and S2, whose logic states determine the output of the current buffer 20. In the example of FIG. 1, the plurality of heater control signals includes first and second heater control signals H1 and H2 for respectively driving the heater 30 using a first high voltage, i.e., 110V, or a second high voltage, i.e., 220V. Accordingly, the heater drive unit 40 is comprised of first and second heater drivers 41 and 42, which essentially comprise first and second form A contact relays X1 and X2, respectively. The first and second heater drivers 41 and 42 are respectively connected to the first and second high voltages for driving, using one or the other voltage, the heater 30 according to the first and second heater control signals H1 and H2.

The first heater driver 41 includes a first diode D101 connected across the control terminals of the first relay X1 between a positive DC voltage source at its cathode and the H1 line at its anode, and a series connection of a first resistor R101 and a first capacitor C101 connected across the power terminals of the first relay between the first high voltage on the resistor side and the heater 30 on the capacitor side. Thus, when the first power control signal is low, current flows through the coil of the first relay X1, closing the relay switch and thus applying the first high voltage to the heater 30 via the enabled heater driver. Conversely, when the first heater control signal H1 is high, there is no current flow through the coil of the first relay X1, opening the relay switch so that the first high voltage is not applied to the heater 30.

Likewise, the second heater driver 42 includes a second diode D102 connected across the control terminals of the second relay X2, between a positive DC voltage source at its cathode and the H2 line at its anode, and a series connection of a second resistor R102 and a second capacitor C102 connected across the power terminals of the second relay, between the second high voltage on the resistor side and the heater 30 on the capacitor side. Thus, when the second heater control signal H2 is low, current flows through the coil of the second relay X2, closing the relay switch and thus applying the second high voltage to the heater 30 via the enabled heater driver. Conversely, when the second heater control signal H2 is high, there is no current flow through the coil of the second relay X2, opening the relay switch so that the second high voltage is not applied to the beater 30.

It should be appreciated that only one of the plurality of heater control signals output from the current buffer 20 is to be low at any given time. That is, while one heater control signal (e.g., H1) is low, all others (e.g., H2) should remain high.

Thus, if the current buffer 20 fails, the heater control signals will typically float high and both control terminals of each relay will therefore remain high, so that the relays remain open and no voltage is applied to the heater 30. As a result, the heater 30 cannot be driven, which is an inconvenience to the user but poses little danger. In the event of a microcomputer malfunction, however, there may be instances where the control signal output from the microcomputer 10 controls the current buffer 20 such that more than one heater control signal goes low, whereby the heater drive unit 40 would attempt to drive the heater 30 using multiple voltages, essentially shorting high-voltage lines together.

Therefore, the laundry drier according to the related art, in which the above-described heater control circuit is employed, may fail during operation and is potentially dangerous. That is, there may conditions where the heater cannot be driven, which renders the laundry drier wholly inoperative, and there may be conditions where a high-voltage short circuit is created, which may have catastrophic results.

SUMMARY OF THE INVENTION

Accordingly, the present invention is directed to a laundry dryer that substantially obviates one or more of the problems due to limitations and disadvantages of the related art.

An object of the present invention, which has been devised to solve the foregoing problem, lies in providing a laundry dryer in which minimum dryer function is ensured and dangerous short-circuit conditions are prevented.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a laundry dryer having a heater control circuit. The heater control circuit comprises a heater for being driven by a plurality of high voltages via a plurality of heater drivers; a microcomputer for outputting a control signal according to a user input, the control signal determining the high voltage drive is of the heater; and a heater control interface for generating a plurality of heater control signals corresponding to the plurality of high voltages, based on the control signal of the microcomputer, the plurality of heater control signals selectively enabling only one of the plurality of heater drivers.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

Figure 2:
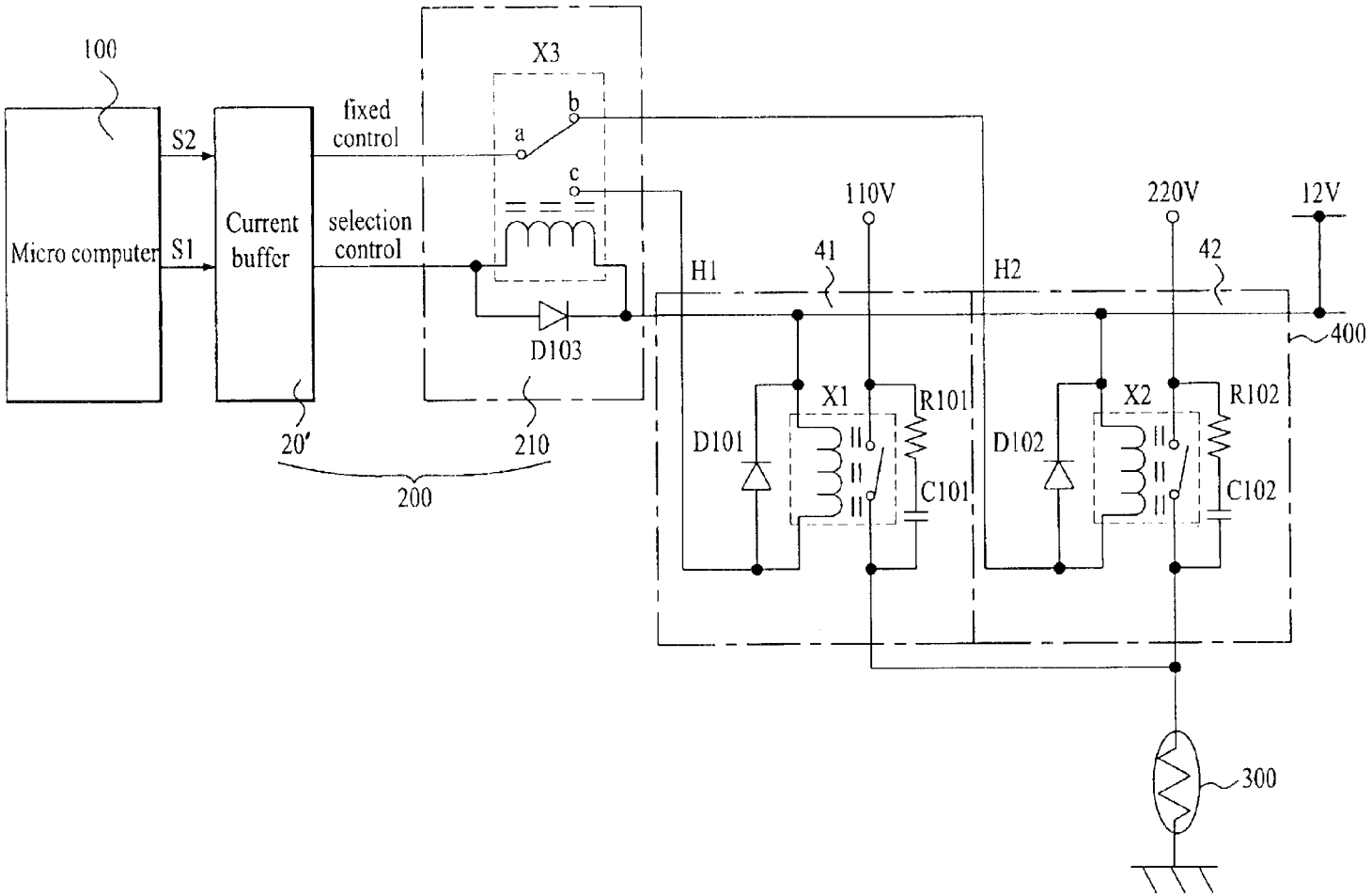
FIG. 2 is a schematic diagram of a heater control circuit of a laundry dryer according to the present invention.

The laundry dryer according to the present invention is provided with a heater control circuit as shown in FIG. 2. The heater control circuit is comprised of a microcomputer 100 for outputting a control signal according to a user input; a heater control interface 200 for generating a plurality of heater control signals based on the control signal of the microcomputer; and a heater drive unit 400 having a plurality of heater drivers for driving a heater 300 using one of a plurality of high voltages as determined by the heater control signals. The heater and heater drive unit of the present invention are fundamentally the same in construction and operation as the corresponding elements of the control circuit of the laundry drier according to the related art.

The control signal of the microcomputer 100 is output via first and second ports S1 and S2, whose logic states determine the output of the heater control interface 200. The heater control interface 200 includes a current buffer 20' having outputs directly corresponding to the logic states of the first and second ports S1 and S2 and a switching circuit 210 for selectively outputting the plurality of heater control signals. The outputs of the current buffer 20' include a fixed control output and a selection control output.

The switching circuit 210 is comprised of a third relay X3 operated by a contact movement according to the first heater control signal output from the current buffer 20', and a third diode D103 connected across the control terminals of the third relay X3 between a positive DC voltage source at its cathode and the selection control output of the current buffer 20' at its anode The third relay X3 is preferably a form C contact relay configured such that a first contact a is connected to the fixed control output of the current buffer 20' and second and third contacts b and c are respectively connected to the heater drivers. Here, the diode D103 is preferably a 1N4148.

In the embodiment of the present invention, the plurality of heater control signals includes first and second heater control signals H1 and H2 for respectively driving the heater 300 using a first high voltage, i.e., 110V, or a second high voltage, i.e., 220V. It should be appreciated, however, that the plurality of heater control signals may include further control signals, for controlling heater drivers in addition to those shown in FIG. 2, by adopting a switching circuit having additional output terminals for selective connection to the fixed control output according to the selection control output.

Figure 1:
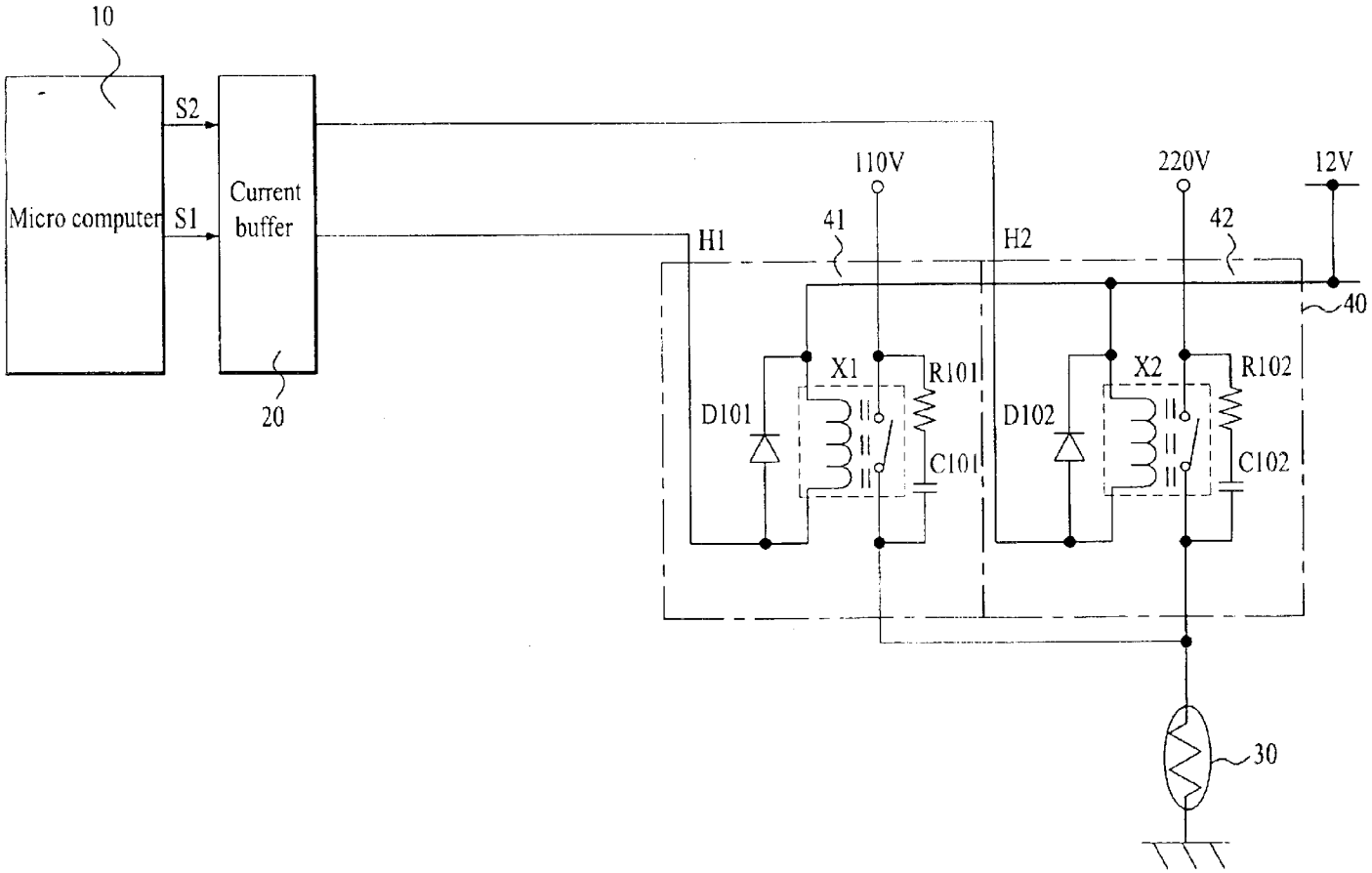
FIG. 1 Related Art
FIG. 1 is a schematic diagram of a heater control circuit of a laundry dryer according to a related art.

As above, the heater 300 is driven according to a user selection based on laundry type, whereby the control terminal of the selected heater driver of the heater drive unit 400 is pulled low while the corresponding terminals of the unselected heater drivers are held high. In other words, the heater control signal H1 or H2 must be pulled low. Also, the selection control output and fixed control output of the current buffer 20' correspond to the first and second heater control signals H1 and H2 of the circuit of FIG. 1, respectively, and the control signal output of the microcomputer 100, output via first and second ports S1 and S2, is configured such that the logic level of the fixed control output is always low, while the logic level of the selection control output determines heater driver selection.

Thus, in the operation of the above-constructed heater control circuit, a user selection for driving the heater 300 using the first heater driver 41 produces a logic low output from the selection control output of the current buffer 20', to pull the third contact c low, thus closing the first relay X1 by outputting the first heater control signal H1 as a low level signal. With the first relay X1 thus closed, the first heater driver 41 is enabled so that the first high voltage (110V) drives the heater 300. At the same time, the second contact b of the third relay X3 is open, allowing the second first heater control signal H2 to float high, so that the second heater driver 42 is disabled and the second relay X2 remains open. Conversely, a user selection for driving the heater 300 using the second heater driver 42 produces a logic high output from the selection control output of the current buffer 20', to pull the second contact b low, thus closing the second relay X2 by outputting the second heater control signal H2 as a low level signal. With the second relay X2 thus closed, the second heater driver 42 is enabled so that the second high voltage (220V) drives the heater 300. At the same time, the third contact c of the third relay X3 is open, allowing the first heater control signal H1 to float high, so that the first heater driver 41 is disabled and the first relay X1 remains open.

Due to the inherent properties of the switching circuit 210, the high-voltage lines of a laundry dryer adopting the present invention can never be shorted together, and the heater can always be driven. That is, the first contact a of the third relay X1 can never be simultaneously connected to the second and third contacts b and c, and the first contact is always connected to one of the other contacts. Accordingly, by adopting the laundry dryer of the present invention, having a heater control circuit provided with a heater control interface employing a form C contact relay between a current-buffered microcomputer output and plurality of heater drivers, heater drive capability is ensured even if the current buffer output fails and dangerous short-circuit conditions are avoided even if the microcomputer experiences a logical malfunction.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A laundry drier having a heater control circuit, the heater control circuit comprising:

a heater for being driven by a plurality of high voltages via a plurality of heater drivers;

a microcomputer for outputting a control signal according to a user input, the control signal determining the high voltage drive of said heater; and a heater control interface for generating a plurality of heater control signals corresponding to the plurality of high voltages, based on the control signal of said microcomputer, the plurality of heater control signals selectively enabling only one of the plurality of heater drivers.

2. The apparatus as claimed in claim 1, wherein the plurality of heater drivers consists of enabled and disabled heater drivers.

3. The apparatus as claimed in claim 2, wherein said heater control interface comprises a switching circuit for selectively outputting only one of the plurality of heater control signals as a first logic level signal for enabling only one of the plurality of heater drivers.

4. The apparatus as claimed in claim 3, wherein said switching circuit outputs a second logic level signal to the disabled heater drivers.

5. The apparatus as claimed in claim 3, wherein said switching circuit comprises a form C contact relay.

6. The apparatus as claimed in claim 1, wherein the outputted control signal of said mircrocomputer is output from a plurality of logical output ports.

7. The apparatus as in claim 6, further comprising a current buffer having outputs corresponding to logic states the plurality of logical output ports of said microcomputer.

8. The apparatus as claimed in claim 6, wherein the control signal output comprises first and second output ports, the first output port having a logic state determining the high voltage drive of said heater and the second output port held at a fixed value.

9. The apparatus as claimed in claim 8, wherein the fixed value of the second output port of said microcomputer is a logic low.

* * * * *